US006024525A

United States Patent [19]

Yamanaka

[11] Patent Number: 6,024,525

[45] Date of Patent: Feb. 15, 2000

[54] TAPE HEATING APPARATUS AND BOOKBINDING APPARATUS

[75] Inventor: Yuji Yamanaka, Kawasaki, Japan

[73] Assignee: Canon Kabushiki Kaisha, Tokyo, Japan

[21] Appl. No.: 08/842,710

[22] Filed: Apr. 17, 1997

[30] Foreign Application Priority Data

Apr. 17, 1996 [JP] Japan ..... 8-095663

[51] Int. Cl.[7] ..... B42B 5/00; B42C 9/00

[52] U.S. Cl. ..... 412/36; 412/11; 412/14; 412/33; 412/37; 412/41; 412/900; 412/902

[58] Field of Search ..... 412/41, 902, 900, 412/14, 33, 37, 36, 11

[56] References Cited

U.S. PATENT DOCUMENTS 5,569,012 10/1996 Kosasa et al. ..... 412/33
5,742,456 4/1998 Kinjo et al. ..... 360/109

*Primary Examiner*—Willmon Fridie, Jr.
*Assistant Examiner*—Mark T. Henderson
*Attorney, Agent, or Firm*—Fitzpatrick, Cella, Harper & Scinto

[57] ABSTRACT

The present invention relates to a tape heating apparatus in which both side portions of a bind tape can positively be adhered to front and rear surfaces of a sheet bundle without creating any swollen portions. When a thickness of the sheet bundle is smaller than a predetermined value, side heaters perform a first heating/pressurizing operation at a position in the vicinity of a bound edge of the sheet bundle and then performs a second heating/pressurizing operation at a position spaced apart from the bound edge of the sheet bundle by a predetermined distance. In the first heating/pressurizing operation, portions of a thick hot melt adhesive layer existing on the front and rear surfaces of the sheet bundle are melted to be flattened, to thereby eliminate swollen portions. In the second heating/pressurizing operation, thin hot melt adhesive layers are melted, to thereby positively adhere both width-wise side portions of the bind tape to the front and rear surfaces of the sheet bundle.

10 Claims, 16 Drawing Sheets

TAPE HEATING APPARATUS AND BOOKBINDING APPARATUS

BACKGROUND OF THE INVENTION

1. Field of the Invention

The present invention relates to a tape heating apparatus used in a bookbinding apparatus for automatically gluing or bookbinding a sheet bundle.

2. Related Background Art

It is already known to provide an on-line system in which a series of operations from image formation on a sheet to bookbinding of imaged sheets are continuously performed in a line.

Such an on-line system as shown in FIG. 5 includes a reading and supply apparatus 100 for supplying sheets one by one, an image forming apparatus 200 for forming an image on the supplied sheet, a bookbinding apparatus 300 for gluing a sheet bundle comprised of a plurality of imaged sheets, and a sorting apparatus 400 for sorting the imaged sheets, which apparatuses are connected with each other.

The bookbinding apparatus 300 shown in FIG. 6 includes a sheet convey apparatus 500, a sheet aligning apparatus 600, a tape heating apparatus 700A, a plurality of tape reels 800*a*, 800*b*, a book-bond bundle convey apparatus 900 and a plurality of stackers 1000*a*, 1000*b*.

In the bookbinding apparatus 300, the imaged sheet not to be book-bound is passed through a path 501; whereas, the imaged sheet to be book-bound is conveyed to the sheet aligning apparatus 600 through a path 502. In this case, a flapper 503 closes the path 501 and opens the path 502.

FIG. 7 shows the sheet aligning apparatus 600 in detail. The imaged sheet sent from the path 502 is discharged onto an align tray 602 by a pair of convey-in rollers 601. In this case, the sheet is guided by upper guides 603*a*, 603*b*, 603*c* and a lower guide 604.

The sheet discharged on the align tray 602 is conveyed along the tray 602 by an align paddle 605 rotated in an anti-clockwise direction, so that a tip end of the sheet abuts against tip end reference shutters 606*a*, 606*b*. Further, lateral edges of the sheet are regulated by a fixed align fence 607*a* and a movable align fence 607*b* (movable in directions shown by the double-headed arrow). In this way, the tip ends and lateral edges of the sheets discharged on the align tray 602 are aligned with each other at predetermined positions on the align tray 602. When the aligning of a predetermined number of imaged sheets on the align tray 602 is finished, left and right fixed grippers 608*a* and movable grippers 608*b* (movable in directions shown by the double-headed arrow) of a sheet bundle convey apparatus 608 waiting at a sheet bundle pinching position (near a tip end of the align tray 602) are operated to pinch the aligned sheet bundle 307, as shown in FIG. 8A.

Then, as shown in FIG. 8B, the tip end reference shutters 606*a*, 606*b* are retarded and the conveyance of the sheet bundle 307 by means of the grippers 608*a*, 608*b* is started. In this case, the sheet bundle 307 is supported by guides 609*a*, 609*b*, and 609*c* moved in synchronous with the grippers 608*a*, 608*b*. Incidentally, at the time when the conveyance of the sheet bundle 307 is started, stop fingers 610*a*, 610*b* are positioned as shown in FIG. 7 to temporarily store further imaged sheets discharged onto the align tray 602.

When a trail end of the sheet bundle 307 leaves the align tray 602, as shown in FIG. 8C, the tip end reference shutters 606*a*, 606*b* are returned to their initial positions. Further, the stop fingers 610*a*, 610*b* are returned to their original positions shown in FIG. 6, with the result that the temporarily stored imaged sheets are dripped onto the align tray 602.

FIG. 10 shows a tape supply apparatus 611. A bind tape T wound around the tape reel 800*a* or 800*b* is fed out by a pair of feed rollers 612 and is cut by a tape cutter 613 by a predetermined length. The cut bind tape T is supplied, by a pair of convey rollers 614, to a tape convey apparatus (carriage) 615 waiting at a tape receiving position (position X1 in FIG. 11). Incidentally, the tape convey apparatus 615 includes a plurality of pairs of rollers 616–618.

The tape convey apparatus 615 which has received the bind tape T at the tape receiving position is shifted to a tape transferring position (position X2 in FIG. 11), where the bind tape T is fed out. As shown in FIG. 12, the bind tape T fed out from the tape convey apparatus 615 is set on front tape guides 704, 705 (FIGS. 6 and 11) of a main heater (first heating means) 701 of the tape heating apparatus 700A by a pair of convey rollers 619.

FIG. 14 shows a construction of the bind tape T set on the tape guides 704, 705. A thick hot melt adhesive layer B1 is coated on one surface of the bind tape T at a central portion along a longitudinal direction thereof and thin hot melt adhesive layers B2 are coated on the same surface of the bind tape on both sides of the adhesive layer B1. When the bind tape T is set on the tape guides 704, 705, the main heater 701 waiting at the waiting position is shifted to a bookbinding position, thereby starting the pre-heating of the bind tape. As a result, the thick hot melt adhesive layer B1 is melted. FIG. 12 shows such a melted condition.

A tip end (bound end) of the sheet bundle 307 conveyed by the gripers 608*a*, 608*b* is urged against the bind tape T which is being heated by the main heater 701. As a result, the melted hot melt adhesive B1 on the bind tape T penetrates between the sheets of the sheet bundle, thereby gluing the sheet bundle 307. Thereafter, side heaters (second heating means) 702, 703 waiting at their waiting positions are shifted to a bookbinding position, where the both side portions of the bind tape T are pressurized and heated by the side heaters. As a result, thin hot melt adhesive layers B2 are melted, thereby binding the bind tape T to front and rear surfaces of the sheet bundle 307. In this way, the bookbinding operation is completed.

Thereafter, the book-bound sheet bundle (book-bound article) 307 is conveyed by the grippers 608*a*, 608*b* from the bookbinding operation to a transferring position to the book-bound bundle convey apparatus 900 to transfer the book-bound sheet bundle 307 to the book-bound bundle convey apparatus 900. FIG. 9A shows a condition that the book-bound sheet bundle 307 is conveyed to the transferring position and stopped there. When the book-bound sheet bundle 307 reaches the transferring position, receiving trays (rotary trays) 901*a*, 901*b* of the book-bound bundle convey apparatus 900 which were positioned at a home position shown in FIG. 6 are shifted to the transferring position, thereby permitting the receiving trays to receive the book-bound article (this condition is shown in FIG. 9B). Incidentally, the receiving trays 901*a*, 901*b* are shifted rocked upwardly from the home position (waiting position) shown in FIG. 6 to the transferring position. When the book-bound article 307 is rested on the receiving trays 901*a*, 901*b*, the book-bound article 307 is released from the grippers 608*a*, 608*b*, and the grippers are returned to the sheet pinching position of the align tray 602 (this condition is shown in FIG. 9C).

After the grippers 608*a*, 608*b* returning to the sheet pinching position leave the book-bound article 307, the receiving trays 901*a*, 901*b* on which the book-bound article 307 was rested are rocked downwardly to the waiting position of FIG. 6. Meanwhile, the book-bound article 307 is transferred from the receiving trays 901*a*, 901*b* to a feed-in tray (horizontal tray) 902. When the receiving trays 901*a*, 901*b* are returned to the waiting position, the book-bound article 307 starts to be contained into the stacker 1000*a* or 1000*b* by the book-bound bundle convey apparatus 900.

First of all, the feed-in tray 902 is positioned in the vicinity of an upper end of the stacker (this condition is shown in FIG. 13A). Then, the feed-in tray 902 is shifted toward the stacker to position the book-bound article 307 above the stacker (this condition is shown in FIG. 13B). Then, the feed-in tray 902 is lowered to contain the book-bound article 307 into the stacker (this condition is shown in FIG. 13C).

In the case of the conventional bookbinding apparatus 300, the side heaters 702, 703 of the tape heating apparatus 700A perform the heating/pressurizing operation at one time at a position in the vicinity of the bound edge 307*a* of the sheet bundle 307 as shown in FIG. 15 or at a position spaced apart from the bound edge 307*a* of the sheet bundle 307 by a predetermined distance as shown in FIG. 16.

However, as shown in FIGS. 15 and 16, if a thickness (t) of the sheet bundle 307 is smaller than a width of the thick hot melt adhesive layer B1, when the heating/pressurizing operation is effected at the position shown in FIG. 15, since the thick hot melt adhesive layer B1 exists on the front and rear surfaces of the sheet bundle 307, gaps H are created between the thin hot melt adhesive layers B2 and the front and rear surfaces. As the result, both side portions T2, T3 of the bind tape T may not be adhered to the front and rear surfaces of the sheet bundle 307 completely. On the other hand, when the heating/pressurizing operation is effected at the position shown in FIG. 16, since the thick hot melt adhesive layer B1 existing on the front and rear surfaces of the sheet bundle 307 cannot be reduced, swollen portions R are formed in the vicinity of the bound edge 307*a* of the book-bound article 307, thereby worsening the appearance.

SUMMARY OF THE INVENTION

The present invention intends to eliminate the above-mentioned conventional drawbacks, and has an object to provide a tape heating apparatus in which both side portions of a bind tape can positively be adhered to front and rear surfaces of a sheet bundle without creating any swollen portions.

A tape heating apparatus according to the present invention comprises a first heating means for heating a central portion of a bind tape and for penetrating melted adhesive into a bound edge of a sheet bundle urged against the central portion of the bind tape, and a second heating means for heating and pressurizing both side portions of the bind tape to adhere the both side portions of the bind tape to front and rear surfaces of the sheet bundle with melted adhesive.

The apparatus according to the present invention further comprises a control means for controlling the second heating means in such a manner that, when the sheet bundle has a predetermined thickness, the second heating means performs a first heating/pressurizing operation at a first position in the vicinity of the bound edge of the sheet bundle and then performs a second heating/pressurizing operation at a second position spaced apart from the bound edge of the sheet bundle by a predetermined distance.

DETAILED DESCRIPTION OF THE PREFERRED EMBODIMENTS

The present invention will now be explained in connection with an embodiment thereof with reference to the accompanying drawings.

Figure 1:
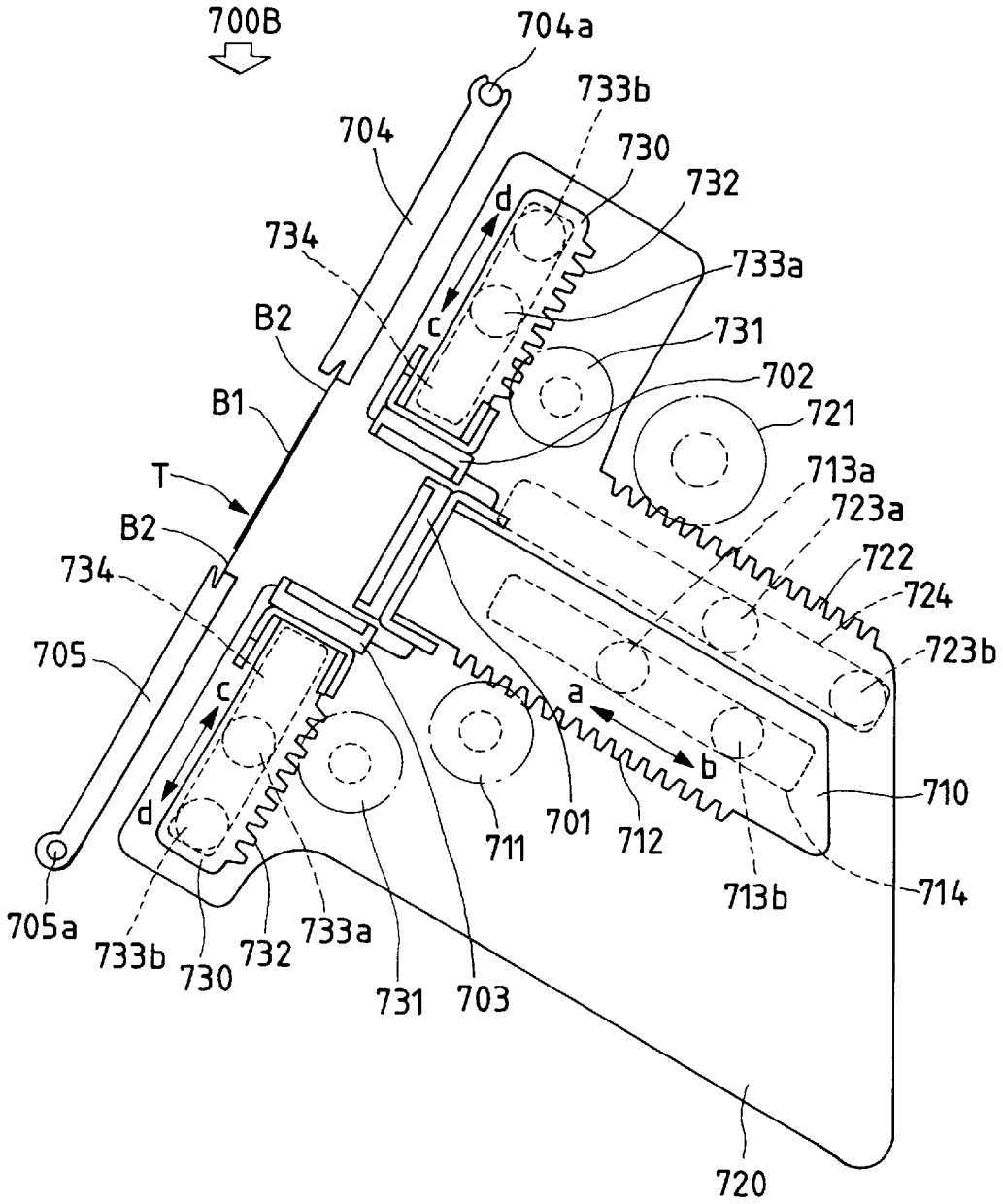
FIG. 1 is a partial sectional view showing an example of a tape heating apparatus according to the present invention.
Figure 6:
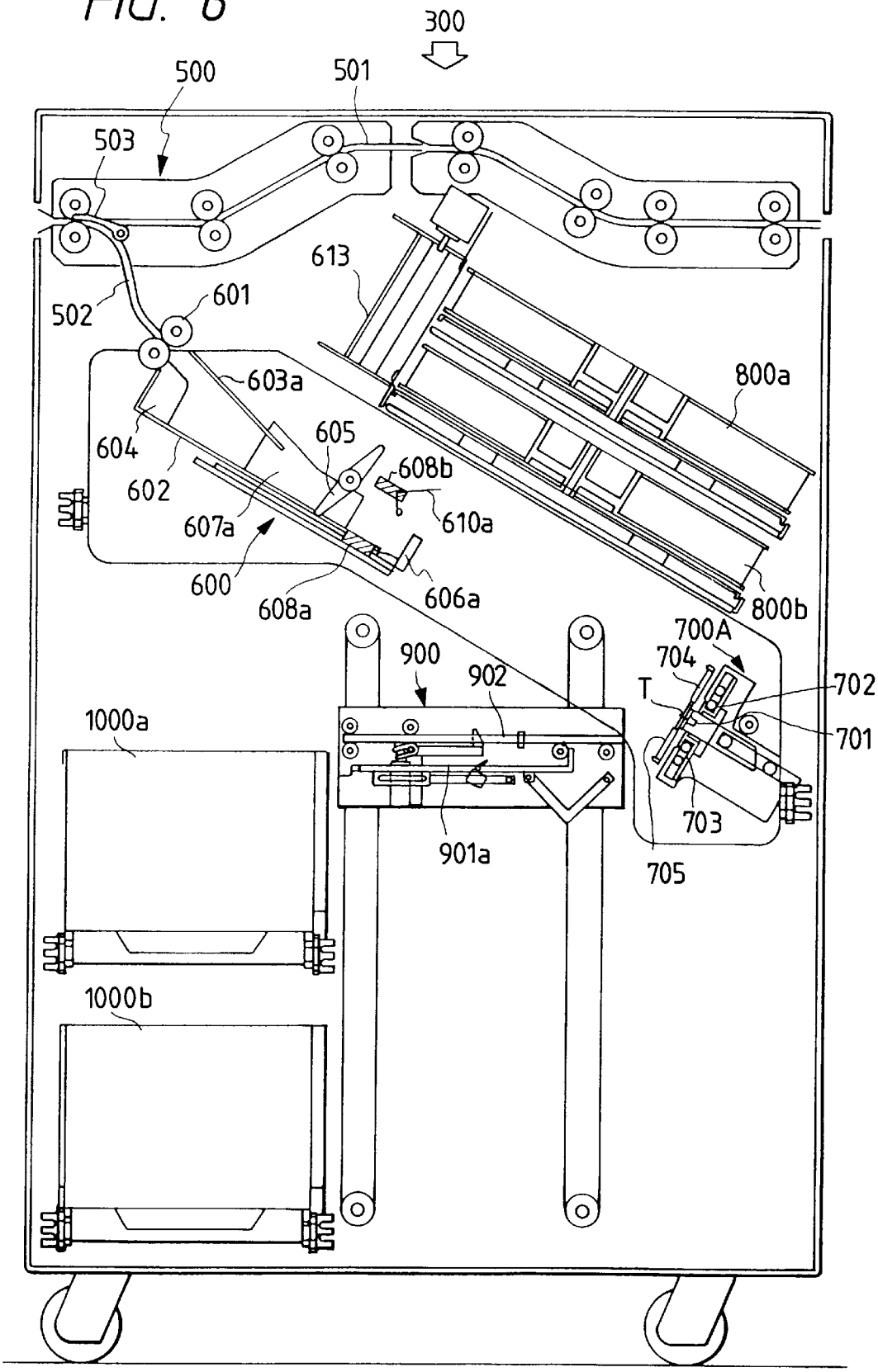
FIG. 6 is a sectional view showing an example of a bookbinding apparatus used in the on-line system.

FIG. 1 shows a tape heating apparatus 700B according to the present invention. Incidentally, the tape heating apparatus can be incorporated into the aforementioned bookbinding apparatus 300 shown in FIG. 6, and elements same as those of the conventional tape heating apparatus 700A will be designated by the same reference numerals.

A main heater 701 is secured to one end of a shift member 710 shiftable in directions (shown by the double-headed arrow a, b) perpendicular to a face of a bind tape T set on tape guides 704, 705. The shift member 710 can be shifted in the directions a, b by transmitting a rotation of a drive gear 711 to a rack gear 712. In this case, a plurality of guide shafts 713*a*, 713*b* formed on a side surface of the shift member 710 are slid in a guide slot 714 formed in a support member (not shown).

Side heaters 702, 703 are attached to end portions of a shift member 720 shiftable in the directions perpendicular to the face of the bind tape T set on tape guides 704, 705. The shift member 720 can be shifted in the directions a, b by transmitting a rotation of a drive gear 721 to a rack gear 722. In this case, a plurality of guide shafts 723*a*, 723*b* formed on a side surface of the shift member 720 are slid in a guide slot 724 formed in the support member (not shown).

The side heaters 702, 703 are secured to ends of shift members 730 shiftable in directions (shown by the double-headed arrows c, d) perpendicular to the directions a, b with respect to the shift member 720. The shift members 730 can be shifted in the directions c, d by transmitting rotations of drive gears 731 to rack gears 732. In this case, a plurality of guide shafts 733*a*, 733*b* formed on side surfaces of the shift members 730 are slid in guide slots 734 formed in the shift member 720. Incidentally, driving forces from drive sources (not shown) such as motors are transmitted to the drive gears 711, 721 and 731.

FIG. 1 shows the main heater 701 and the side heaters 702, 703 when the bind tape T is set on the tape guides 704, 705. In this condition, the main heater 701 for heating a central portion of the bind tape T in a width-wise direction is situated at a position spaced apart from the bind tape T rearwardly by a predetermined distance. This position is a home position for the main heater 701. The side heaters 702, 703 for heating and pressurizing both side portions of the bind tape T in the width-wise direction are situated at positions spaced apart from the bind tape T rearwardly by a predetermined distance. These positions are home positions for the side heaters 702, 703 in the directions a, b. In this case, the side heaters 702, 703 are waiting at positions slightly spaced apart from the main heater 701. These positions are home positions for the side heaters 702, 703 in the directions c, d.

A control system (FIG. 4) for the tape heating apparatus 700B comprises a CPU 2000 for effecting the control. The CPU 2000 includes memories such as a ROM and a RAM, and an I/O portion (not shown). A signal from a distance sensor 2001 of reflection type (to be described later), a signal from a home position sensor 2003 for the main heater and a signal from a home position sensor 2005 for the side heaters are inputted to the I/O portion through A/D converters 2002, 2004, and 2006, respectively. Further, control signals from the I/O portion are outputted to a driver 2008 for a main heater drive motor 2007 and a driver 2011 for a side heater drive motor 2010 through D/A converters 2009, 2012, respectively.

Next, an operation of the tape heating apparatus 700B will be explained with reference to FIGS. 1, 2A, 2B, 3A and 3B.

Figure 2A:
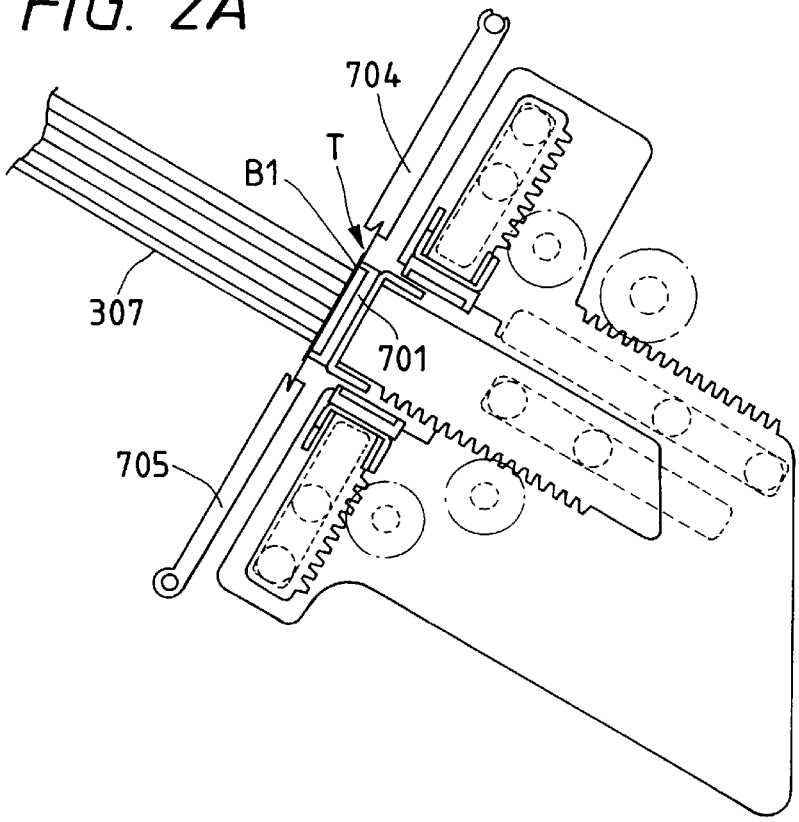
FIGS. 2A and 2B and FIGS. 3A and 3B are partial sectional views of the tape heating apparatus, for explaining an operation of the apparatus.

When the bind tape is set on the tape guides 704, 705, the main heater 701 waiting at its home position is shifted forwardly (in the direction a) until it abuts against a back surface of the bind tape T, to thereby pre-heat the bind tape T. Thereafter, the aligned sheet bundle 307 is conveyed to the bookbinding position, where the bound edge of the sheet bundle 307 is urged against the bind tape T. As a result, melted hot melt adhesive B1 on the bind tape T penetrates between sheets constituting the sheet bundle 307, thereby gluing the sheet bundle (FIG. 2A).

Figure 2B:
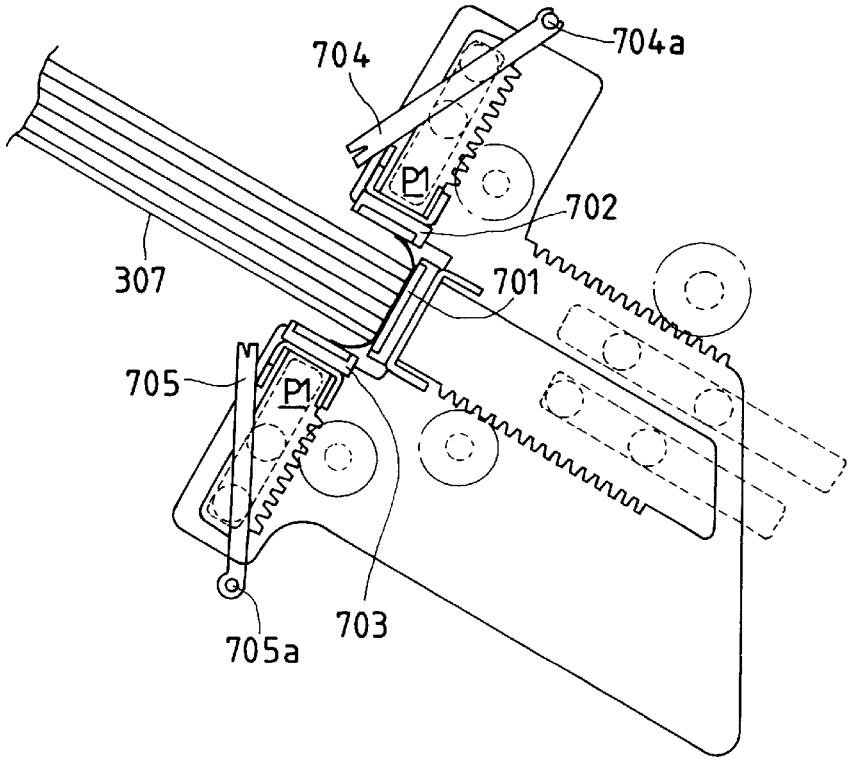

Then, the side heaters 702, 703 waiting at their home positions are shifted forwardly (in the direction a) to a position (first position) P1 slightly exceeding the main heater 701. During the shifting movements of the side heaters 702, 703, the tape guides 704, 705 are rocked around their pivot shafts 704*a*, 705*a* in clockwise and anti-clockwise directions, respectively, thereby bending the both side portions of the bind tape T released from the tape guides 704, 705 toward the sheet bundle 307 (FIG. 2B).

Figure 3A:
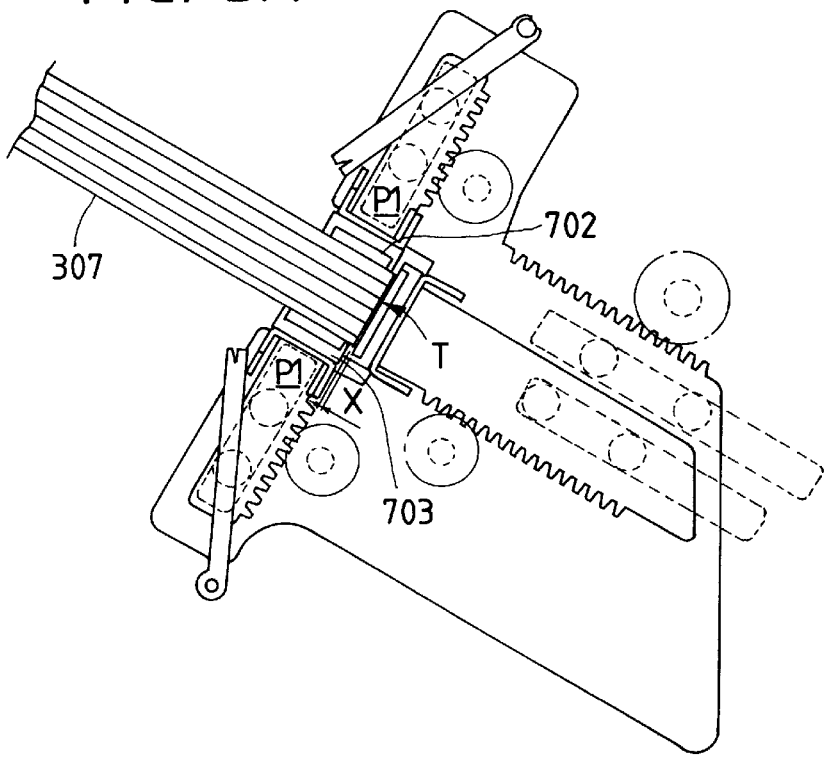
Figure 3B:
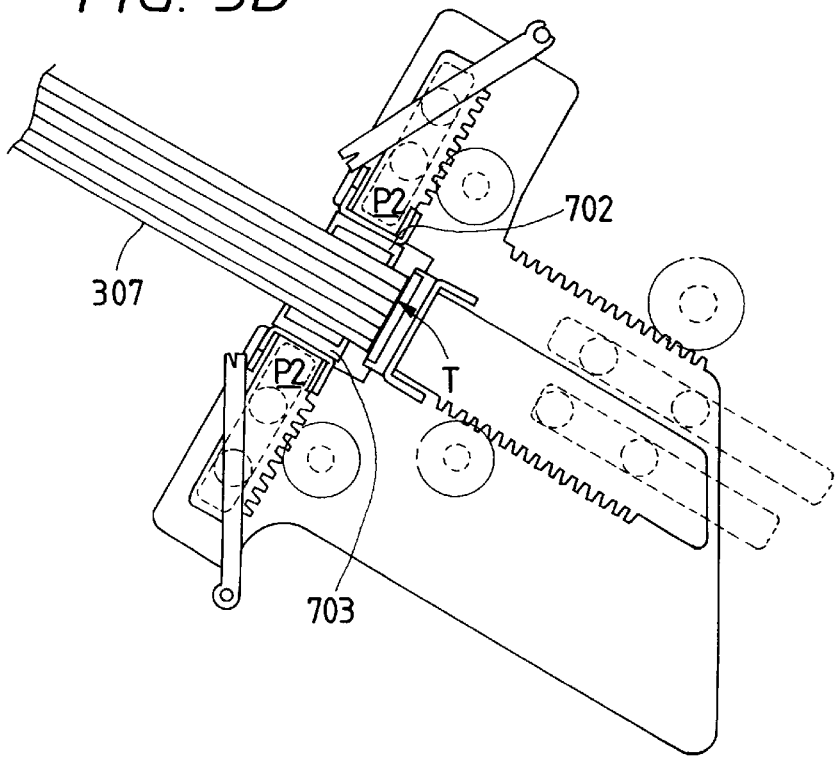

Then, the side heaters 702, 703 stopped at the position P1 are shifted toward the sheet bundle 307 (in the direction c), to thereby heat and pressure the bent both side portions of the bind tape T (FIG. 3A). Then, the side heaters 702, 703 are temporarily returned to their home position in the directions c, d, and then are shifted forwardly (in the direction a) to a position (second position) P2 spaced apart from the bound edge of the sheet bundle 307 by a predetermined distance and are stopped there. Then, the side heaters 702, 703 are shifted toward the sheet bundle 307 (in the direction c) again, thereby heating and pressurizing the both side portions of the bind tape T (FIG. 3B).

After the first and second heating/pressurizing operations of the side heaters 702, 703 are finished, the side heaters 702, 703 are firstly returned to their home positions in the directions c, d and then are returned to their home positions in the directions a, b. Further, when the first and second heating/pressurizing operations of the side heaters 702, 703 are finished, the main heater 701 is returned to its home position (FIG. 1).

Figure 15:
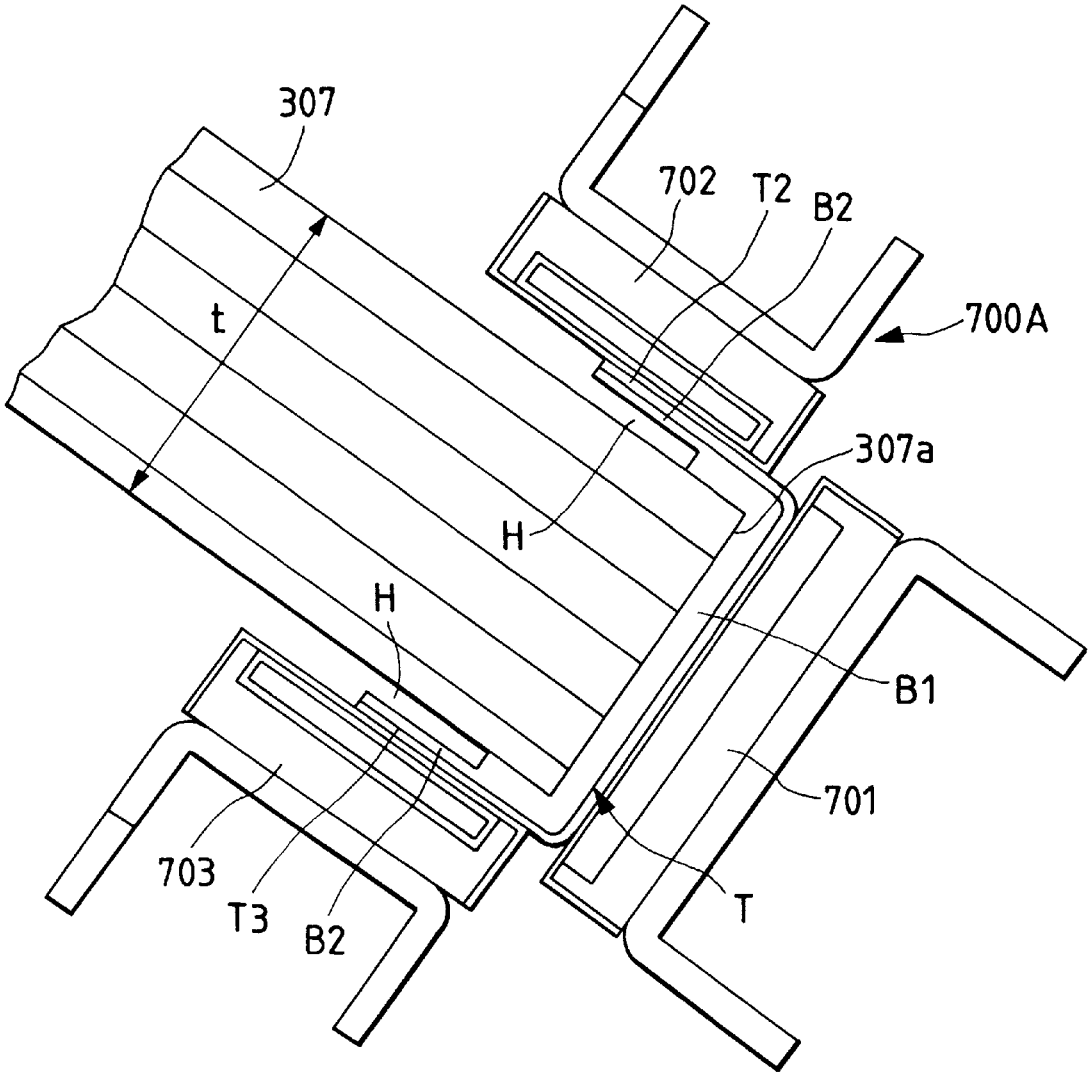
FIGS. 15 and 16 are sectional views of a tape heating apparatus provided in a conventional bookbinding apparatus.
Figure 16:
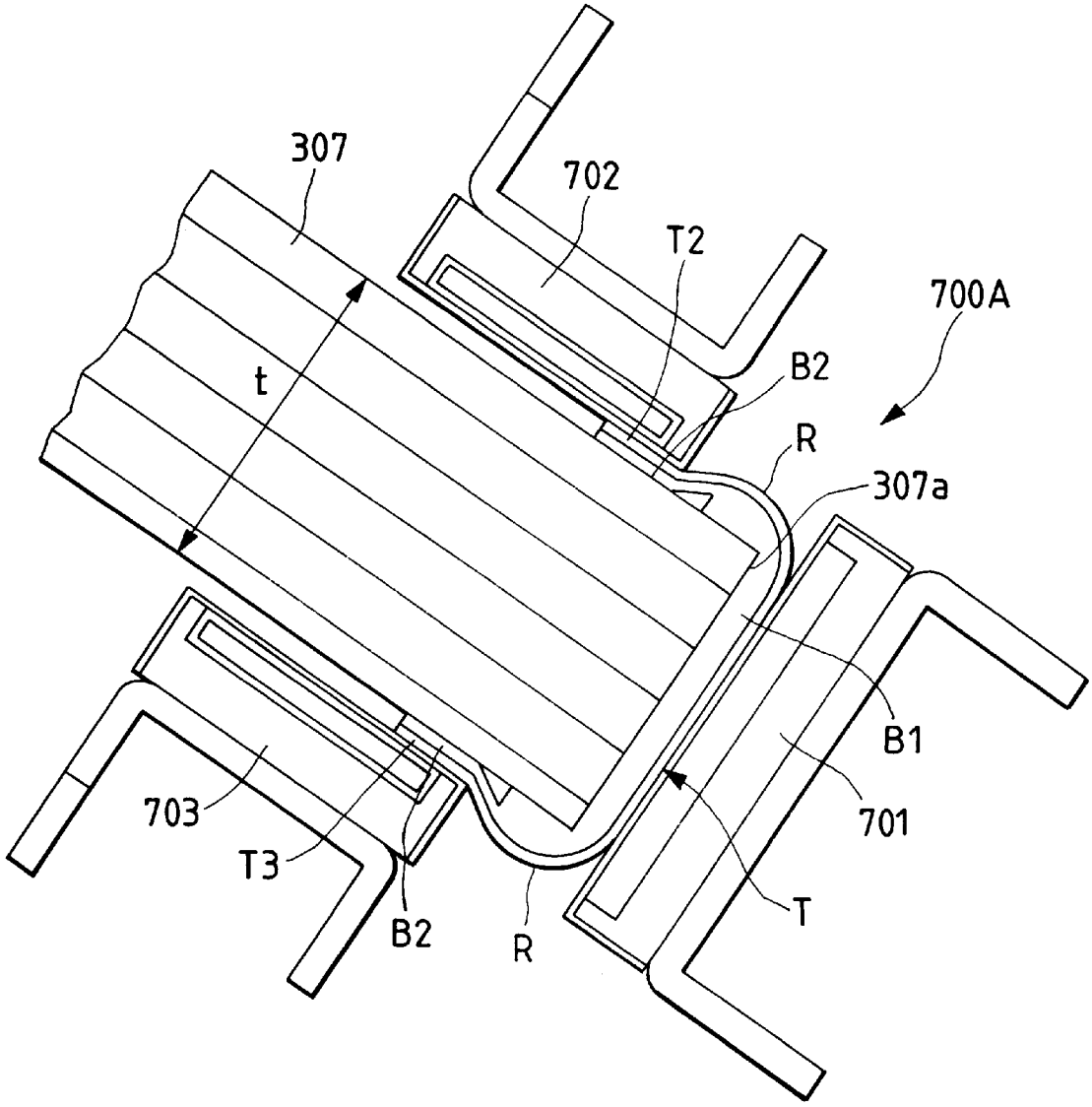

Only when a thickness (t) of the sheet bundle 307 is smaller than a width of the thick hot melt adhesive layer B1, the side heaters 702, 703 of the tape heating apparatus 700B effect the first heating/pressurizing operation at the position P1 and the second heating/pressurizing operation at the position P2. In this case, the thick hot melt adhesive layer B1 exists on the front and rear surfaces of the sheet bundle 307 (refer to FIGS. 15 and 16), and, when the side heaters 702, 703 effect the first heating/pressurizing operation at the position P1 as mentioned above, the thick hot melt adhesive layer B1 is melted to be flattened, so that the swollen portions R is eliminated as shown in FIG. 16. Then, when the second heating/pressurizing operation is effected at the position P2, the thin hot melt adhesive layers B2 are melted to completely adhere the both side portions of the bind tape T to the front and rear surfaces of the sheet bundle 307.

The purpose of the first heating/pressurizing operation of the side heaters 702, 703 is to eliminate the swollen portions R as shown in FIG. 16. In order to achieve this purpose, it is desirable that a distance between the main heater 701 and the side heater 702, 703 at the position P1 is reduced as much as possible. For this reason, the distance X (FIG. 3A) between the main heater 701 and the side heaters 702, 703 at the position P1 is selected to about 1 mm.

The purpose of the second heating/pressurizing operation of the side heaters 702, 703 is to positively adhere the both side portions of the bind tape T to the front and rear surfaces of the sheet bundle 307. In order to achieve this purpose, it is desirable that the side heaters 702, 703 heat and pressurize only portions (of the bind tape T) corresponding to the thin hot melt adhesive layers B2. For this reason, in the illustrated embodiment, the position P2 can be altered in accordance with the thickness of the sheet bundle 307.

For example, when the width of the bind tape T is 40 mm, the width of the thick hot melt adhesive layer B1 is 26 mm and the thickness (t) of the sheet bundle 307 is 10 mm, both side portions of the bind tape T are bent by the operation of the side heaters 702, 703 as shown in FIG. 2B by about 15 mm, respectively. Thus, each bent side portion includes the thick hot melt adhesive layer B1 of about 8 mm (width), and such thick hot melt adhesive layers B1 of about 8 mm exist on the front and rear surfaces of the sheet bundle 307. Accordingly, in this case, the second position P2 is selected to be spaced apart from the first position P1 by 8 mm.

Incidentally, when the thickness of the sheet bundle 307 is the same as the width of the thick hot melt adhesive layer B1 (i.e., 26 mm), since the thick hot melt adhesive layer B1 does not exist on the front and rear surfaces of the sheet bundle 307, both the first and second heating/pressurizing operations are not required, but a single heating/pressurizing operation may be effected at the position P1.

Figure 7:
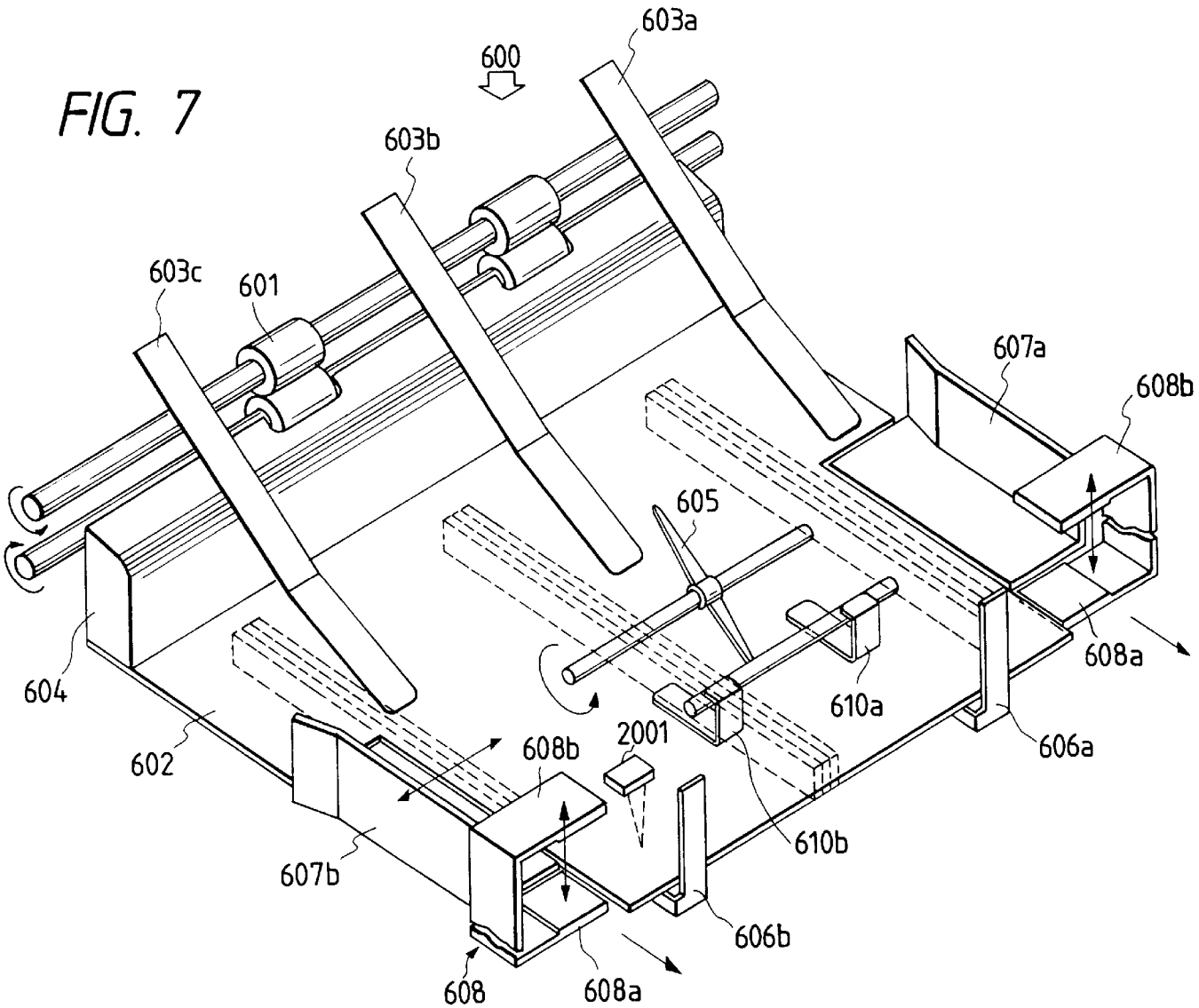
FIG. 7 is a perspective view showing an example of a sheet aligning apparatus provided in the bookbinding apparatus.
Figure 8A:
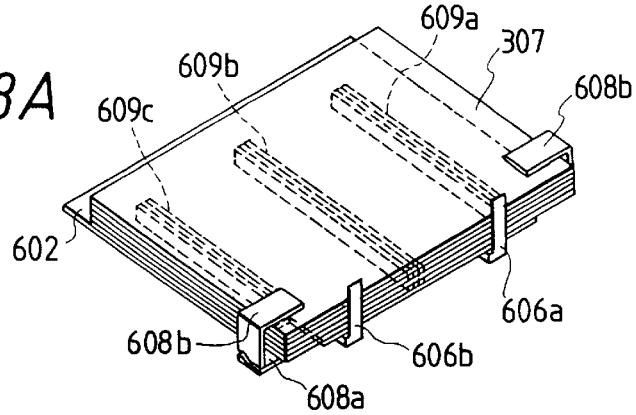
FIGS. 8A, 8B and 8C are perspective views for explaining an operation for conveying a sheet bundle to a bookbinding position.
Figure 8B:
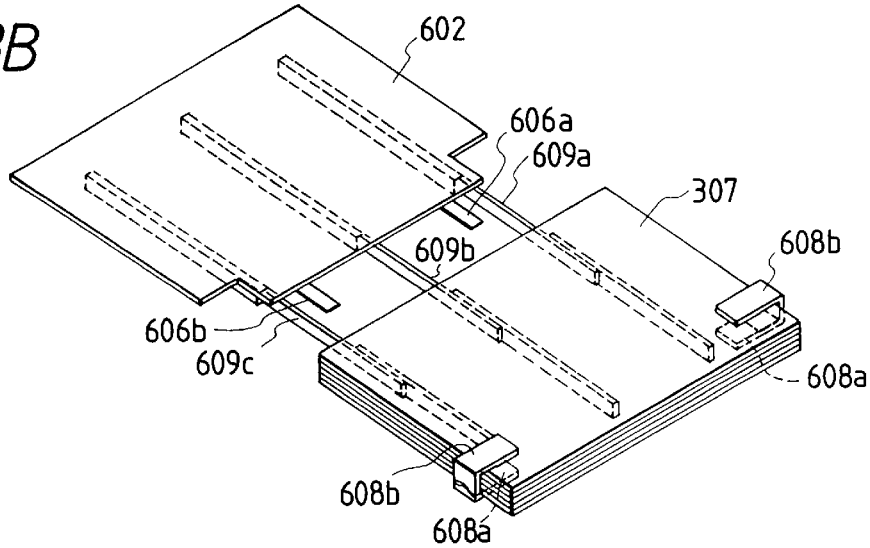
Figure 8C:
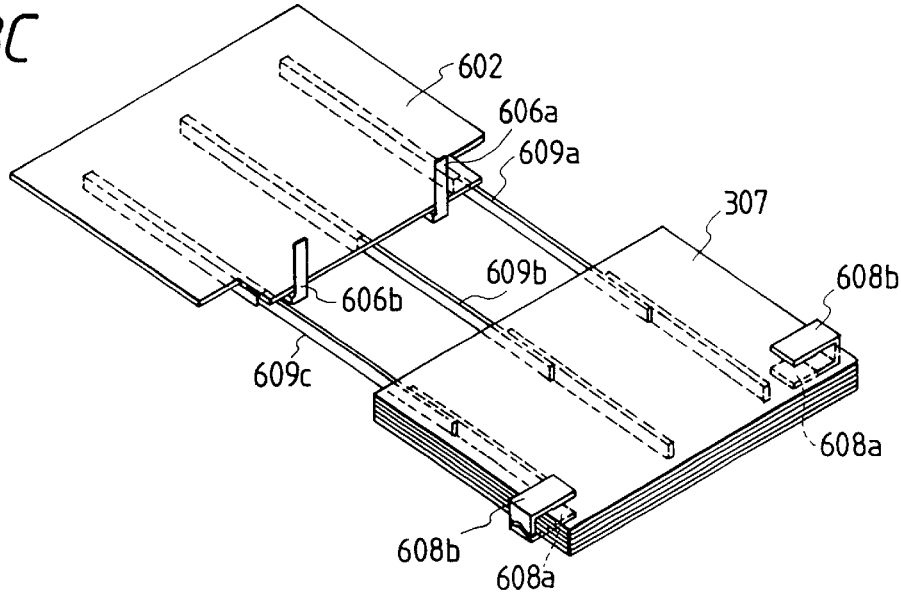
Figure 9A:
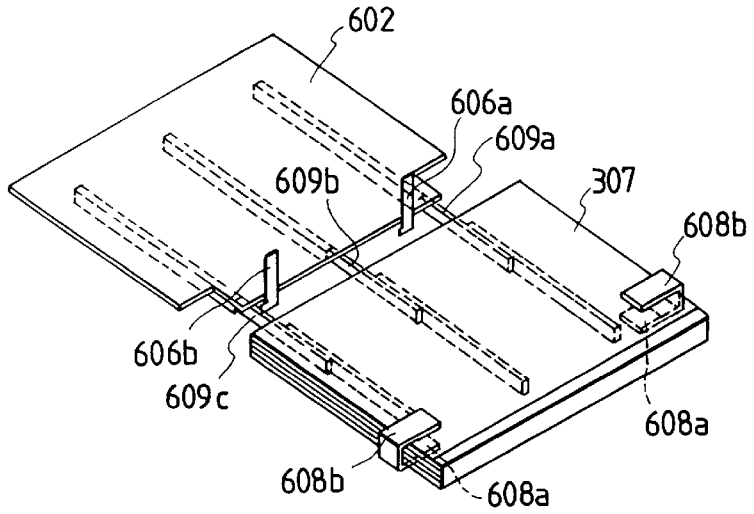
FIGS. 9A, 9B and 9C are perspective views for explaining an operation for transferring a book-bound article to a book-bound bundle convey apparatus.
Figure 9B:
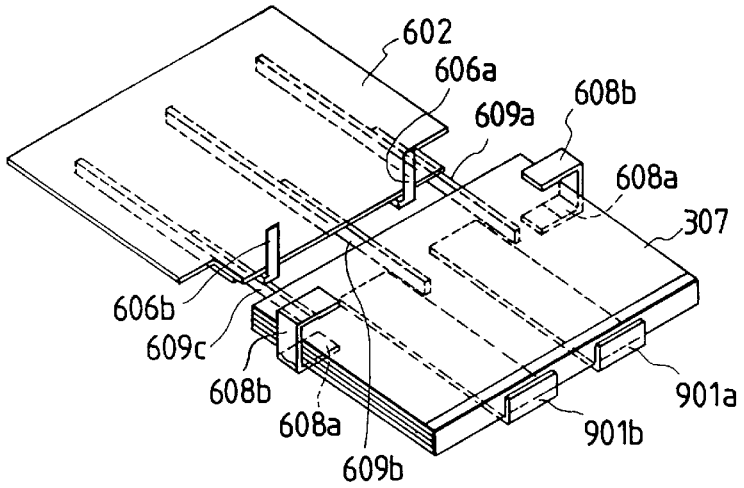
Figure 9C:
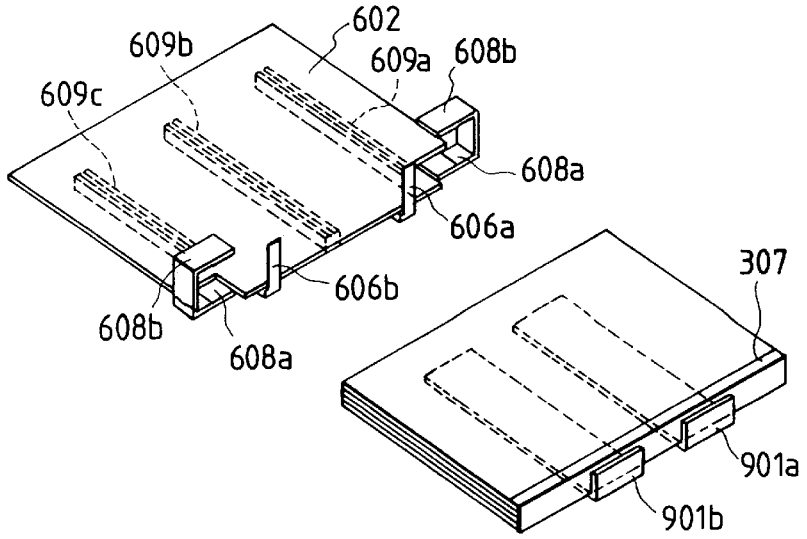
Figure 10:
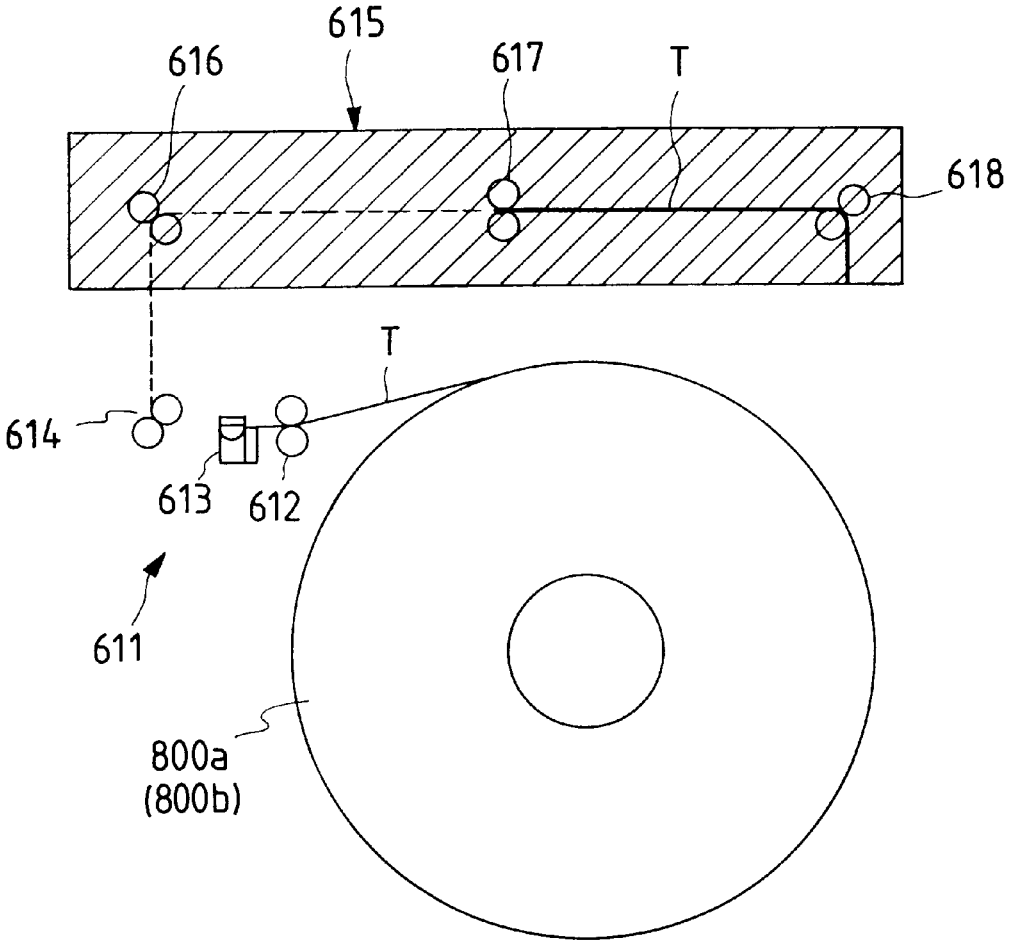
FIG. 10 is a plan view showing a condition that a bind tape cut from a tape supply apparatus is supplied to a tape convey apparatus.
Figure 11:
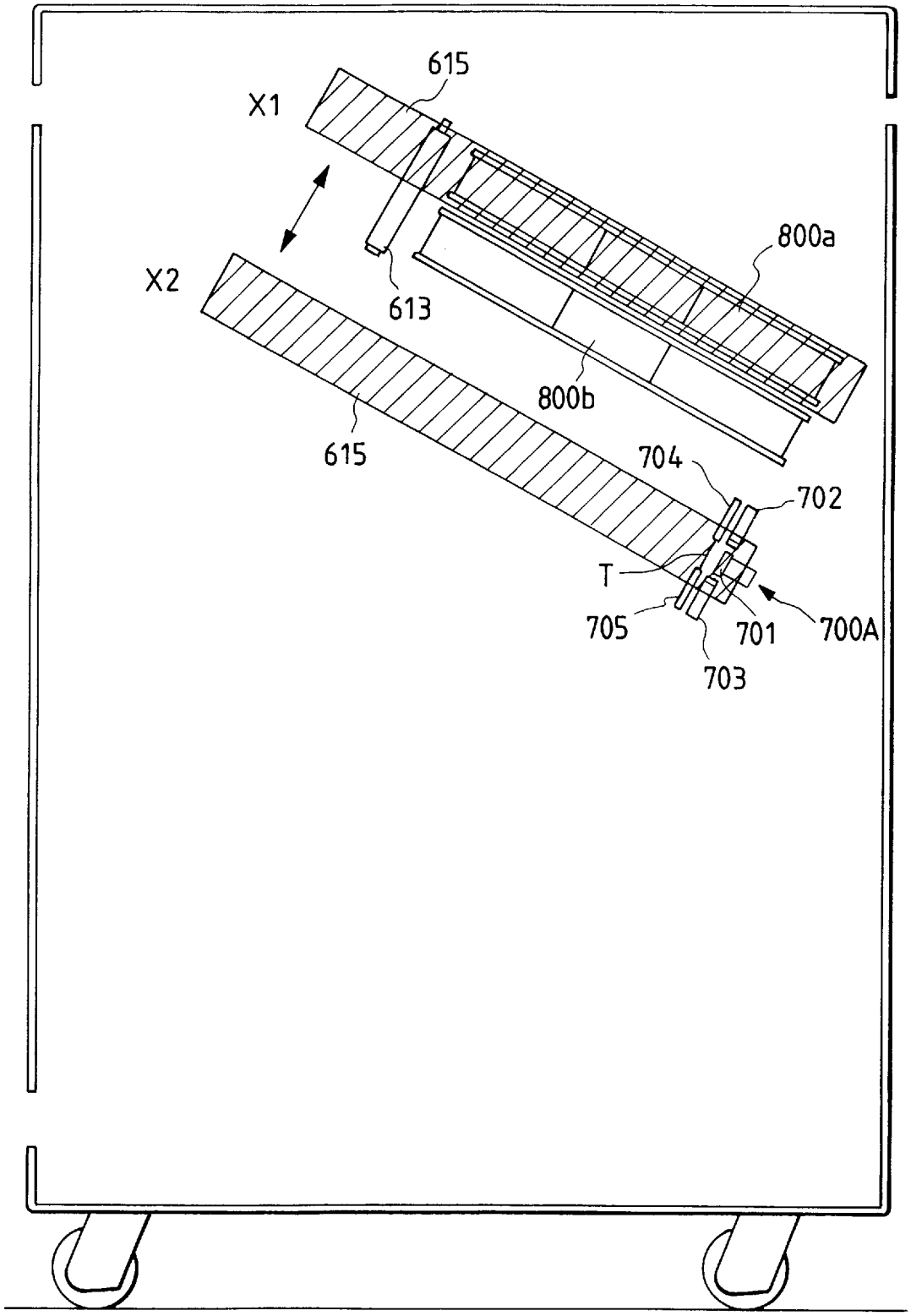
FIG. 11 is a side view showing a condition that the tape convey apparatus is shifted from a tape receiving position to a tape transferring position.
Figure 12:
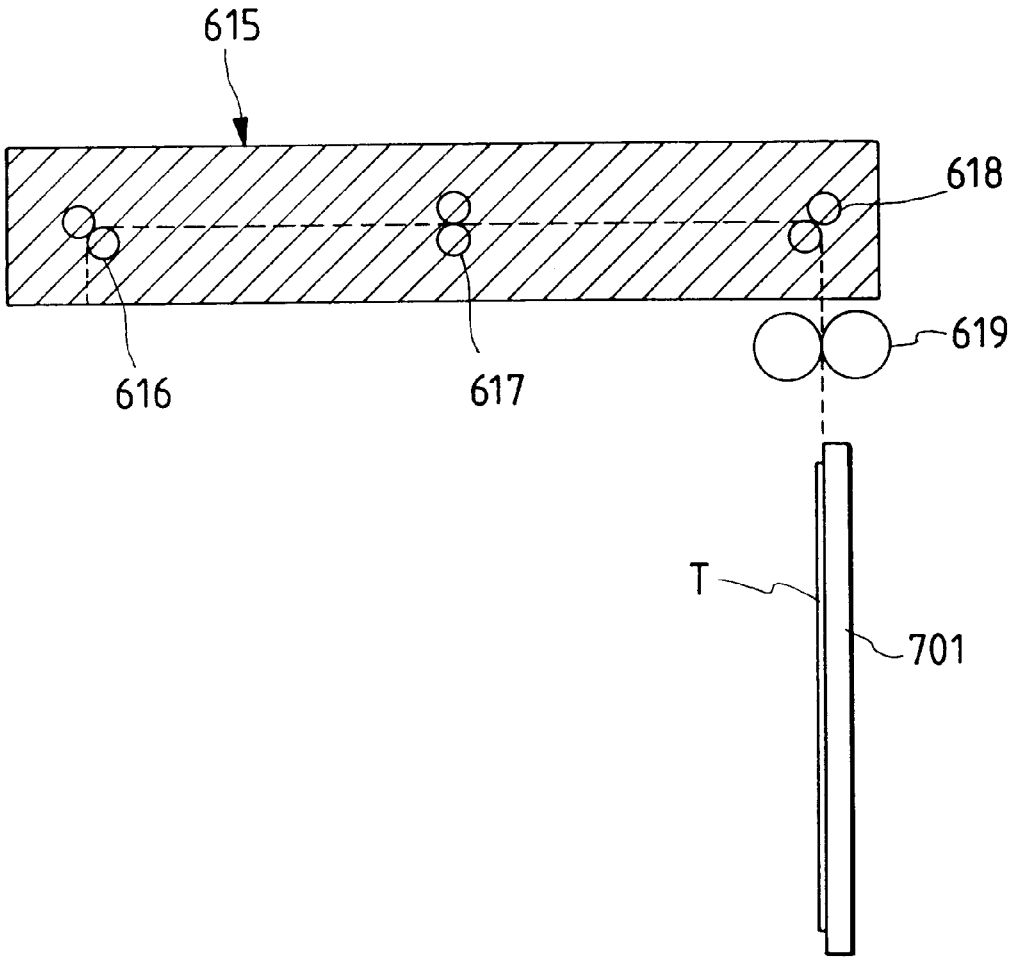
FIG. 12 is a plan view showing a condition that the bind tape is set at a bookbinding position.
Figure 13A:
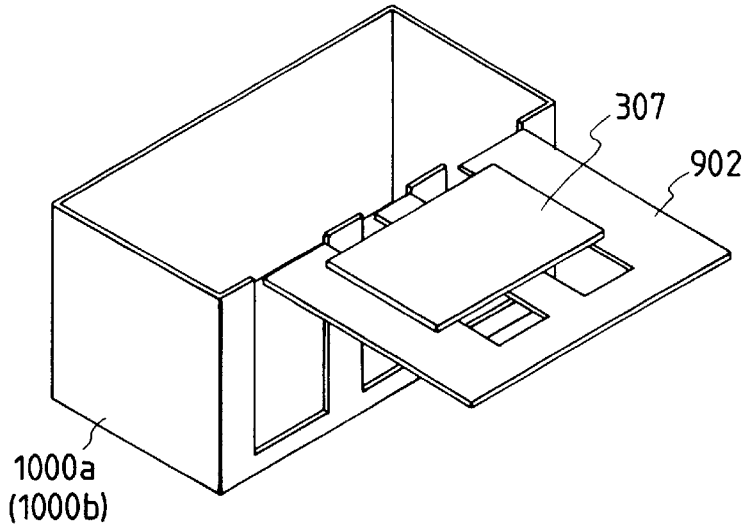
FIGS. 13A, 13B and 13C are perspective views for explaining an operation for the book-bound article is contained into a stacker by the book-bound bundle convey apparatus.
Figure 13B:
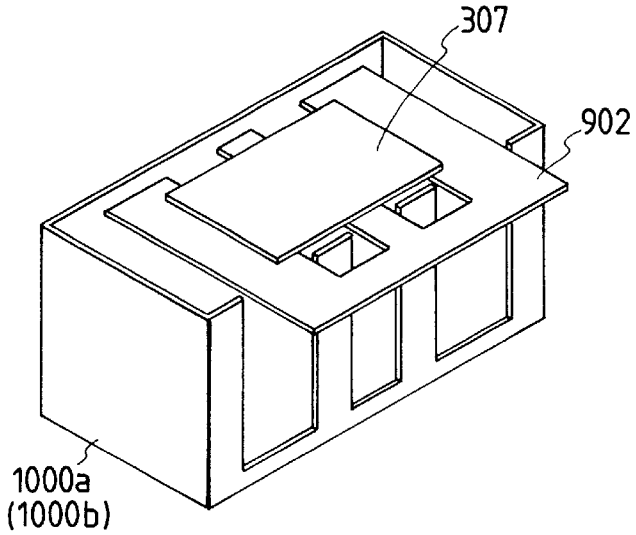
Figure 13C:
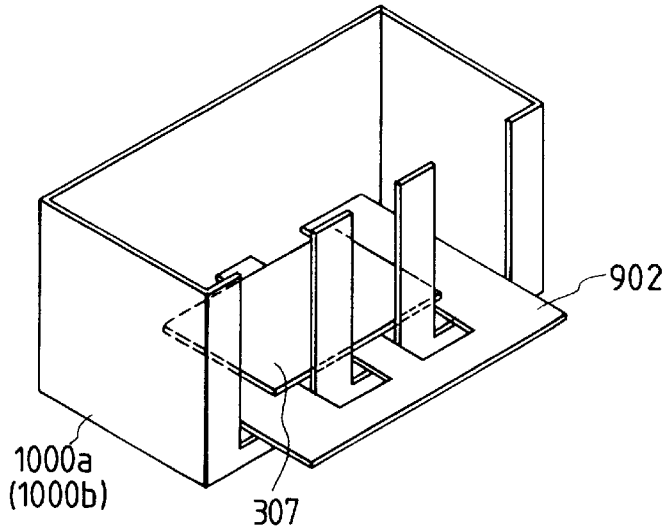
Figure 14:
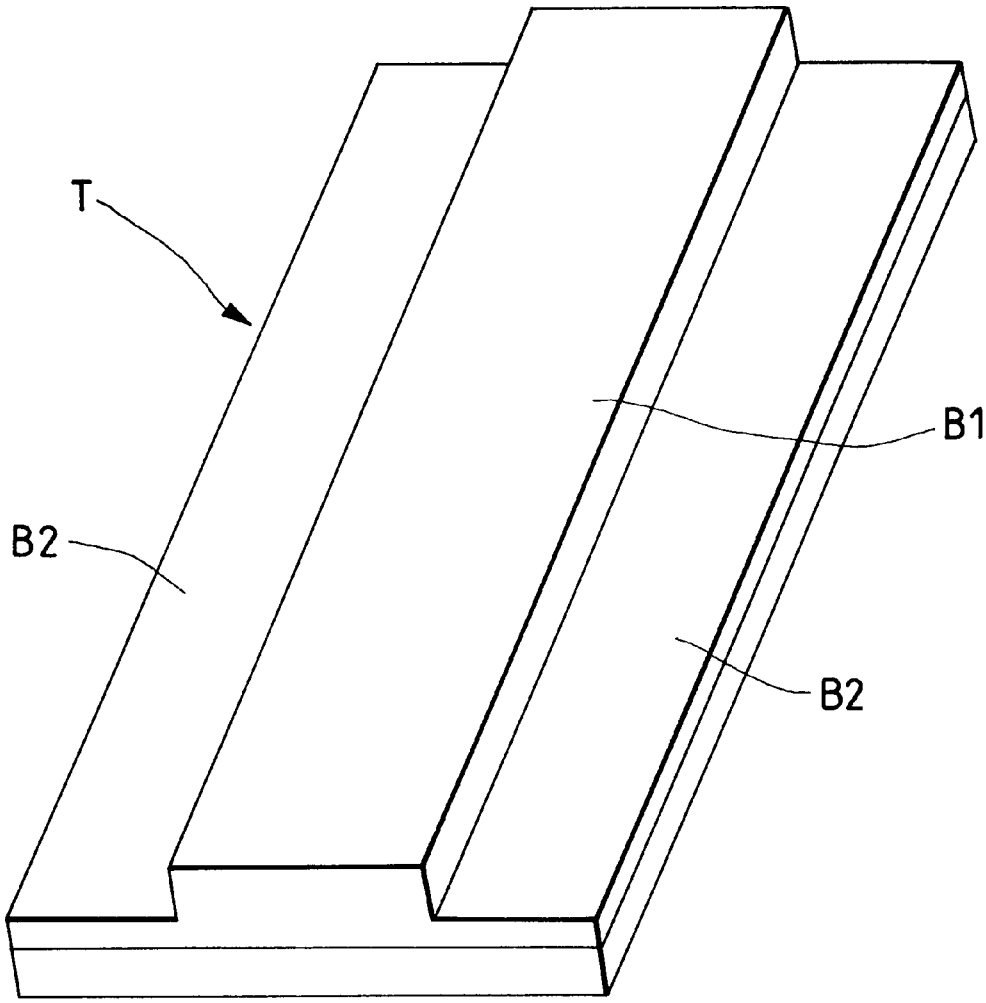
FIG. 14 is a perspective view of the bind tape used in the bookbinding apparatus.

In the illustrated embodiment, the thickness of the sheet bundle 307 is detected by the distance sensor 2001 of reflection type provided in the sheet aligning apparatus 600 shown in FIG. 7. That is to say, a height of the sheet bundle (stack) rested on the align tray 602 is detected by the distance sensor 2001 of reflection type and the thickness of the sheet bundle 307 is calculated on the basis of such a height. A timing when the height of the sheet stack is detected by the distance sensor 2001 of reflection type is after the aligned sheet bundle 307 is pinched by the grippers 608*a*, 608*b* and before the conveyance of the sheet bundle is started.

Incidentally, the thickness of the sheet bundle 307 may be determined by detecting a shift amount of the movable gripper 608*b* by means of an encoder associated with a movable gripper drive mechanism or by the number of the sheets to be bundled.

Thus, in the tape heating apparatus according to the present invention, when the thickness of the sheet bundle is smaller than the predetermined value, since the second heating means performs the first heating/pressurizing operation at the first position in the vicinity of the bound edge of the sheet bundle and then performs the second heating/pressurizing operation at the second position spaced apart from the bound edge of the sheet bundle by the predetermined distance. So, the bind tape can positively be adhered to the front and rear surfaces of the sheet bundle without creating any swollen portions.

What is claimed is:

1. A tape heating apparatus comprising:

first heating means for heating a central portion in a width direction of a bind tape to penetrate a melted adhesive into a bound edge of a sheet bundle urged against the central portion of the bind tape;

second heating means for heating and pressurizing both side portions in the width direction of the bind tape to adhere both side portions of the bind tape to a front surface and a rear surface of the sheet bundle with melted adhesive; and control means for controlling said second heating means so that, when the thickness of the sheet bundle is smaller than a predetermined value, said second heating means performs a first heating/pressurizing operation to adhere both side portions of the bind tape to the front surface and the rear surface of the sheet bundle at a first position in the vicinity of the bound edge of the sheet bundle, and then performs a second heating/pressurizing operation to adhere both side portions of the bind tape to the front surface and the rear surface of the sheet bundle at a second position spaced apart from the bound edge of the sheet bundle by a predetermined distance.

2. A tape heating apparatus according to claim 1, wherein when, the thickness of the sheet bundle exceeds the predetermined value, said second heating means, after performing the first heating/pressurizing operation at said first position, finishes an adhering operation for the bind tape.

3. A tape heating apparatus according to claim 1, wherein said second position is altered in accordance with the thickness of the sheet bundle.

4. A tape heating apparatus according to claim 1, wherein said first heating means melts a thick hot melt adhesive layer coated on the central portion of the bind tape, and said second heating means melts thin hot melt adhesive layers coated on both side portions of the bind tape.

5. A tape heating apparatus according to claim 4, wherein when the thickness of the sheet bundle is smaller than a width of the thick hot melt adhesive layer, said second heating means performs the first heating/pressurizing operation and second heating/pressurizing operation at the first position and second position, respectively.

6. A bookbinding apparatus comprising:

a tape heating apparatus including;

first heating means for heating a central portion in a width direction of a bind tape to penetrate a melted adhesive into a bound edge of a sheet bundle urged against the central portion of the bind tape, second heating means for heating and pressurizing both side portions in the width direction of the bind tape to adhere both side portions of the bind tape to a front surface and a rear surface of the sheet bundle with melted adhesive, and control means for controlling said second heating means so that, when the thickness of the sheet bundle is smaller than a predetermined value, said second heating means performs a first heating/pressurizing operation to adhere both side portions of the bind tape to the front surface and the rear surface of the sheet bundle at a first position in the vicinity of the bound edge of the sheet bundle, and then performs a second heating/pressurizing operation to adhere both side portions of the bind tape to the front surface and the rear surface of the sheet bundle at a second position spaced apart from the bound edge of the sheet bundle by a predetermined distance;

tape convey means for conveying a cut bind tape to a bookbinding position disposed forwardly of said tape heating apparatus; and sheet bundle convey means for conveying the sheet bundle to said bookbinding position.

7. A bookbinding apparatus according to claim 6, wherein when the thickness of the sheet bundle exceeds the predetermined value, said second heating means, after performing the first heating/pressurizing operation at said first position, finishes an adhering operation for the bind tape.

8. A bookbinding apparatus according to claim 6, wherein said second position is altered in accordance with the thickness of the sheet bundle.

9. A bookbinding apparatus according to claim 6, wherein said first heating means melts a thick hot melt adhesive layer coated on the central portion of the bind tape, and said second heating means melts thin hot melt adhesive layers coated on both side portions of the bind tape.

10. A bookbinding apparatus according to claim 9, wherein when the thickness of the sheet bundle is smaller than a width of the thick hot melt adhesive layer, said second heating means performs the first heating/pressurizing operation and second heating/pressurizing operation at the first position and second position, respectively.

* * * * *

UNITED STATES PATENT AND TRADEMARK OFFICE

CERTIFICATE OF CORRECTION

PATENT NO. : 6,024,525

DATED : February 15, 2000

INVENTOR(S): YUJI YAMANAKA

It is certified that error appears in the above-identified patent and that said Letters Patent is hereby corrected as shown below:

COVER PAGE:
Insert: --[*] Notice: This patent issued on a continued prosecution application filed under 37 CFR 1.53(d), and is subject to the twenty year patent term provisions of 35 U.S.C. 154(a)(2).--.

COVER PAGE AT ITEM [56] RC:
U.S. Patent Documents, insert --5,441,374 8/1995 Kosanke et al....412/11--.

COVER PAGE AT ITEM [57] ABSTRACT:
Line 8, "performs" should read --perform--.

Figure 4:
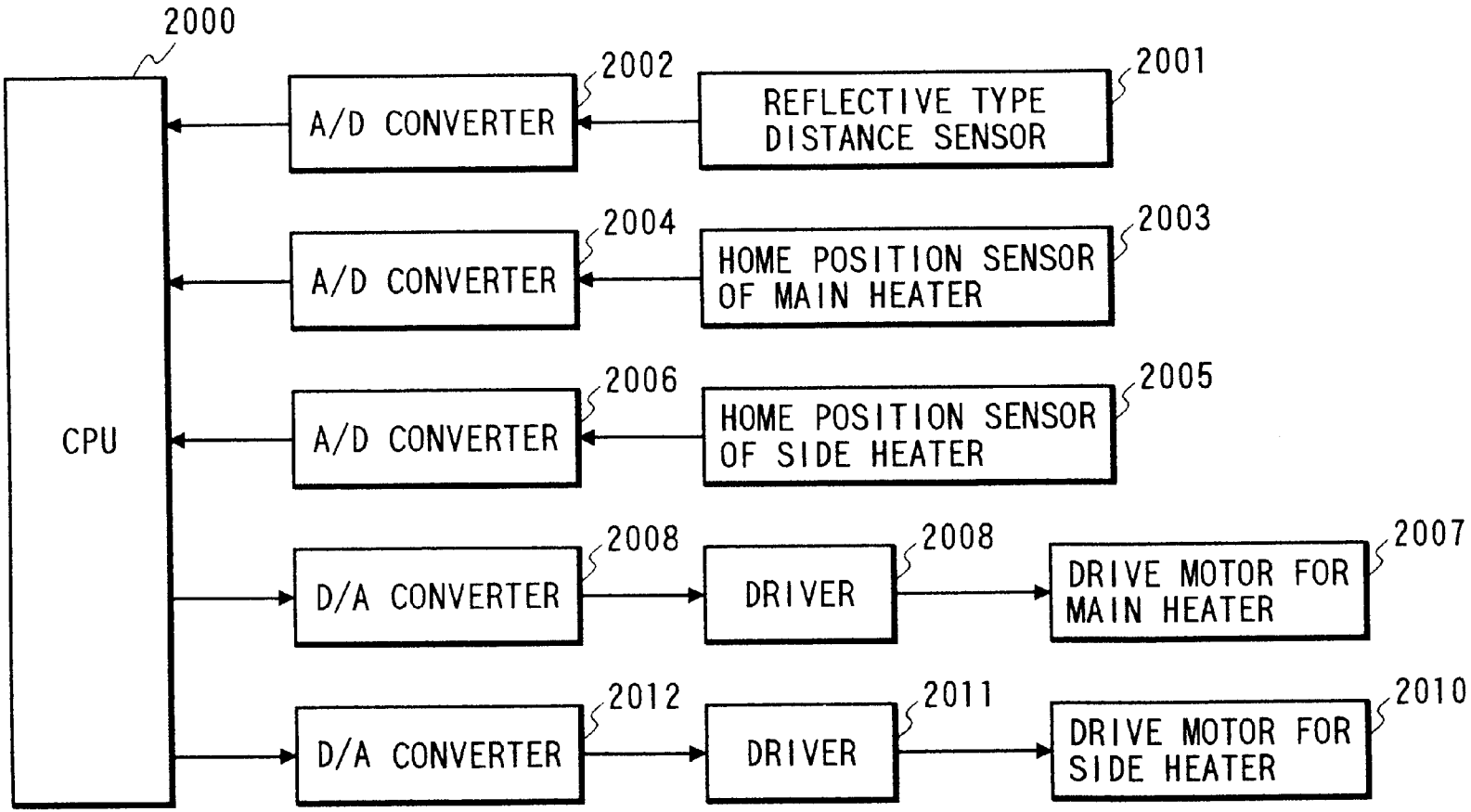
FIG. 4 is an electric block diagram showing a control system of the tape heating apparatus.
Figure 5:
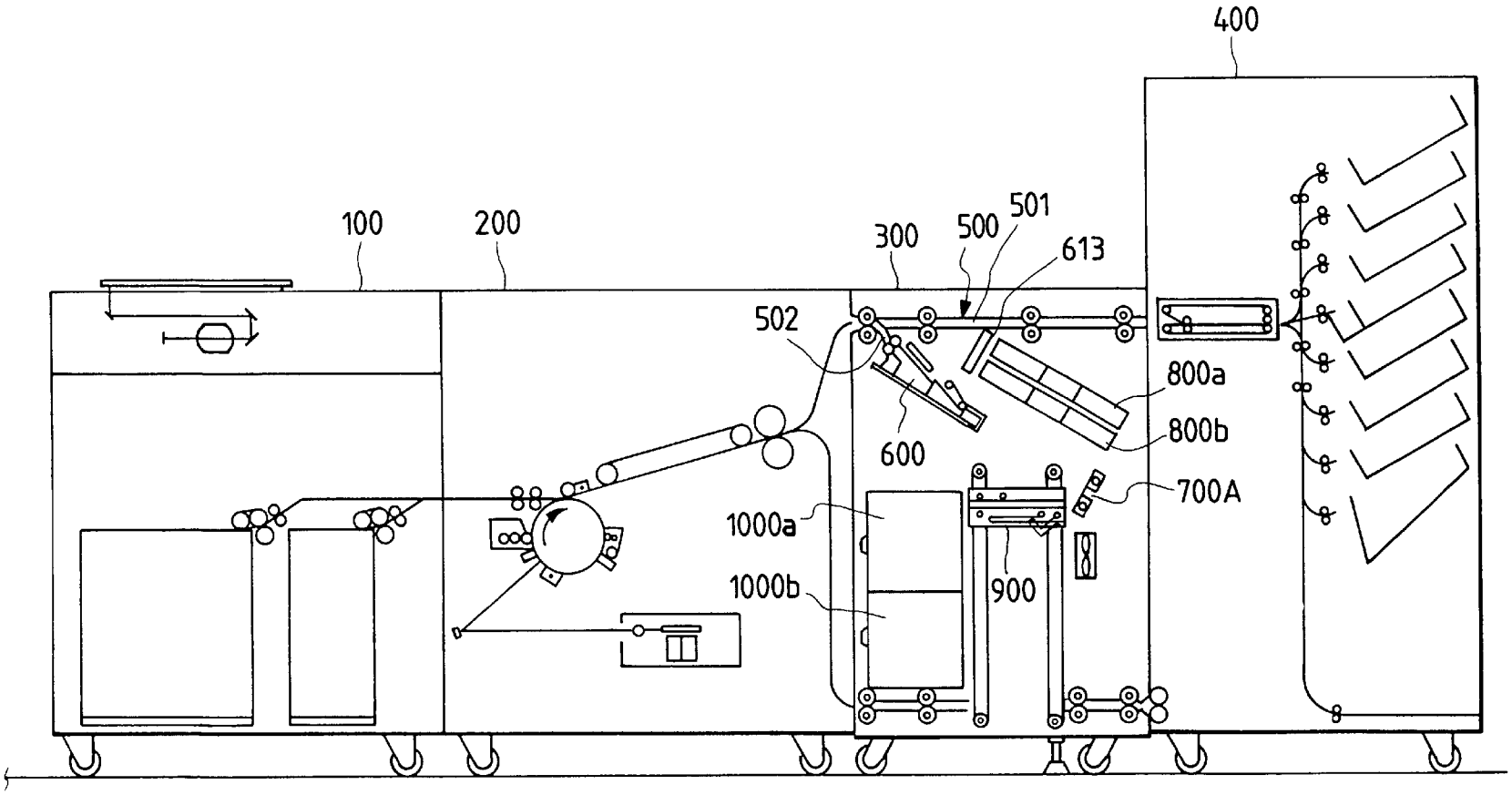
FIG. 5 is a sectional view showing an example of an on-line system.

SHEET NO. 4:
Figure 4, "2008" (1st occurrence) should read --2009--.

COLUMN 1:
Line 21, "which" should read --of which all--;
Line 25, "book-bond" should read --book-bound--;
Line 58, "synchronous" should read --synch--; and
Line 65, "trail" should read --tail--.

UNITED STATES PATENT AND TRADEMARK OFFICE

CERTIFICATE OF CORRECTION

PATENT NO. : 6,024,525

DATED : February 15, 2000

INVENTOR(S): YUJI YAMANAKA

It is certified that error appears in the above-identified patent and that said Letters Patent is hereby corrected as shown below:

COLUMN 2:
Line 58, "rocked" should read --and rocked--.

COLUMN 4:
Line 31, "into" should read --in--.

COLUMN 6:
Line 27, "is" should read --are--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*